United States Patent [19]

Ruff et al.

[11] Patent Number: 4,467,524

[45] Date of Patent: Aug. 28, 1984

[54] CORRUGATED CARTON CUTTER

[75] Inventors: Stanley Ruff, 9 Arbor Dr., New York, N.Y. 10804; Alphonse F. Wolter, Wheatley Heights, N.Y.; Arthur Torrence, Newtown, Conn.

[73] Assignee: Stanley Ruff, New Rochelle, N.Y.

[21] Appl. No.: 460,496

[22] Filed: Jan. 24, 1983

[51] Int. Cl.[3] ..... B26B 3/08

[52] U.S. Cl. ..... 30/2; 30/289

[58] Field of Search ..... 30/2, 289, 293, 295

[56] References Cited

U.S. PATENT DOCUMENTS

| | | | |
|---|---|---|---|
| 2,178,790 | 11/1939 | Henry | 30/2 |
| 2,187,590 | 1/1940 | Lurie | 30/2 |
| 2,301,606 | 11/1942 | Angyal | 30/2 |
| 2,573,381 | 10/1951 | Arnold | 30/2 |
| 3,037,278 | 6/1962 | Genetti | 30/2 |
| 3,052,977 | 9/1962 | Wise | 30/2 |
| 3,430,339 | 3/1969 | Hobson | 30/2 |
| 3,525,152 | 8/1970 | Fattori | 30/2 |
| 4,012,836 | 3/1977 | Baer | 30/2 |
| 4,031,616 | 6/1977 | Hines | 30/2 |
| 4,205,440 | 6/1980 | Morgan | 30/2 |

*Primary Examiner*—Jimmy C. Peters

*Attorney, Agent, or Firm*—Kirschstein, Kirschstein, Ottinger & Israel

[57] ABSTRACT

A cutting tool for cutting open corrugated shipping cartons includes a cutting blade and a holding arrangement for the cutting blade. The holding arrangement includes a holding member on which the cutting blade is held in its cutting position by being accommodated in a recess and having a stationary pin extend into a slot thereof. The holding arrangement includes a contact surface which engages the edge region of the respective carton at the side wall thereof, and a distancing surface which engages the top wall of the carton during the cutting operation to determine the distance of the cutting blade from the top wall, while the contact surface determines the degree of penetration of the cutting edge of the cutting blade into the interior of the shipping carton. These surfaces are so positioned as to avoid any damage to the contents of the shipping carton. A cover for the cutting blade is hingedly mounted on the holding arrangement by a reduced-thickness hinge portion integral with the holding member and the cover. A confining member of a generally C-shaped configuration embraces the holding member and has a slot accommodating a part of the cutting blade and the hinge. The confining member confines the cutting blade between itself and the holding member and is guided on the latter for movement in the longitudinal direction of the slot.

29 Claims, 12 Drawing Figures

FIG. 4
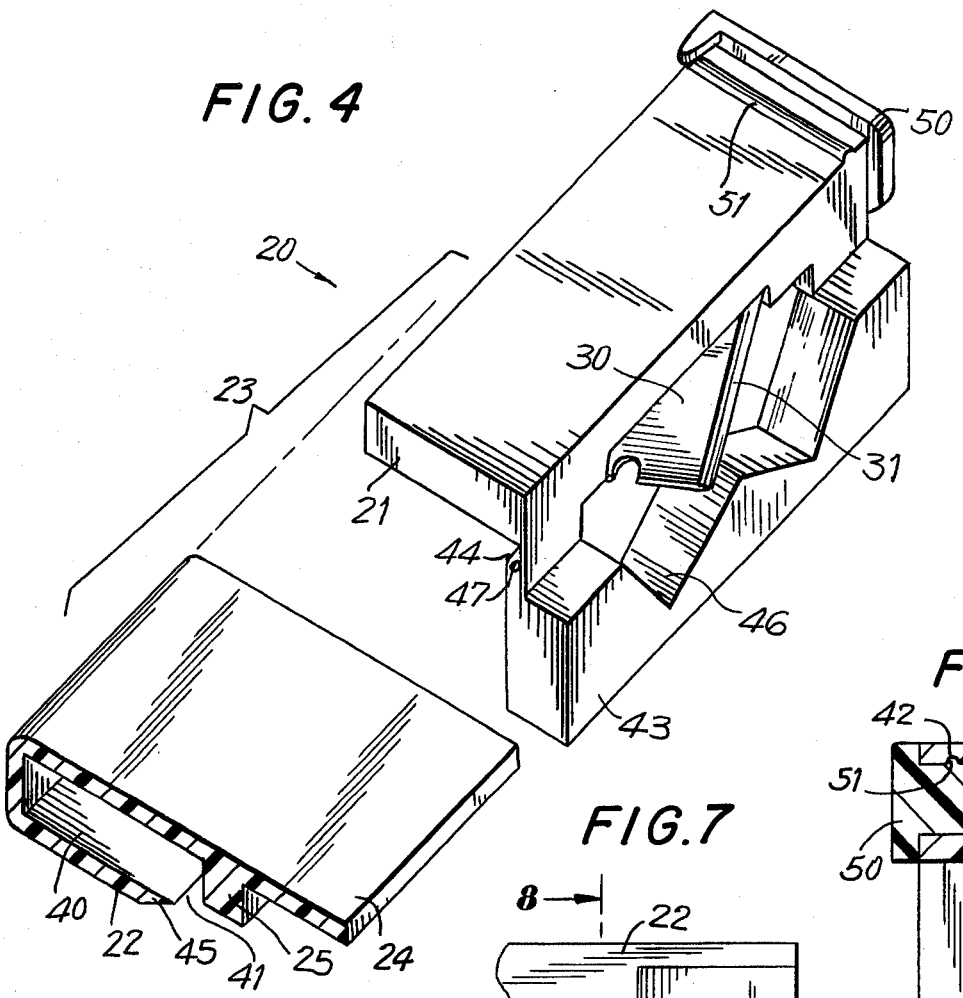
FIG. 6
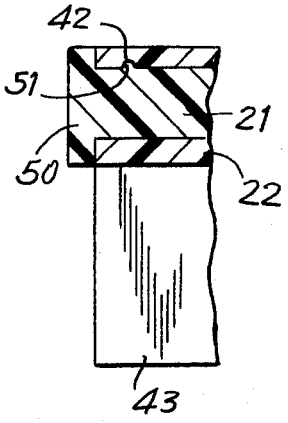
FIG. 7
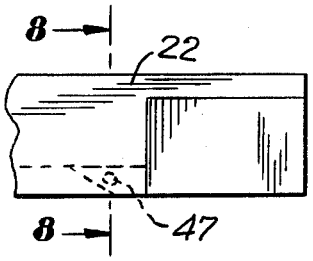
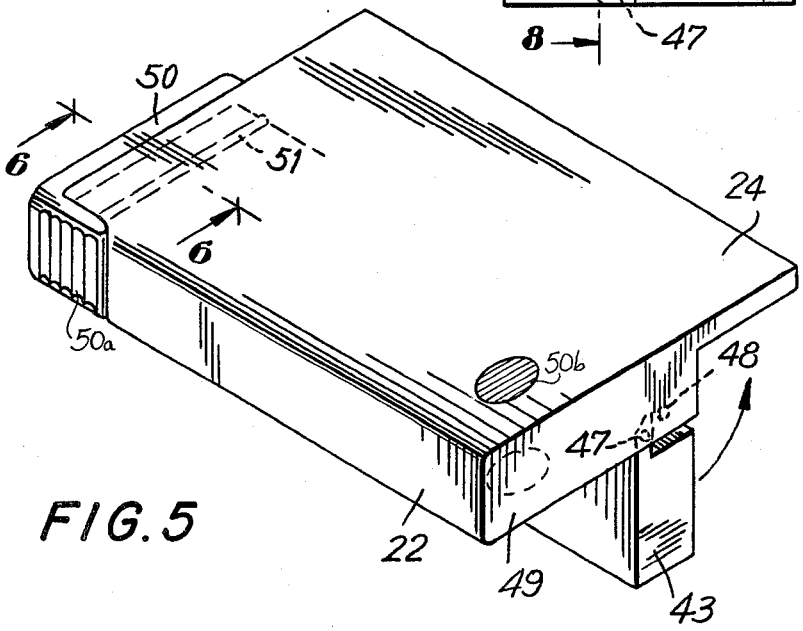
FIG. 5
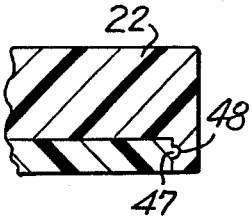
FIG. 8

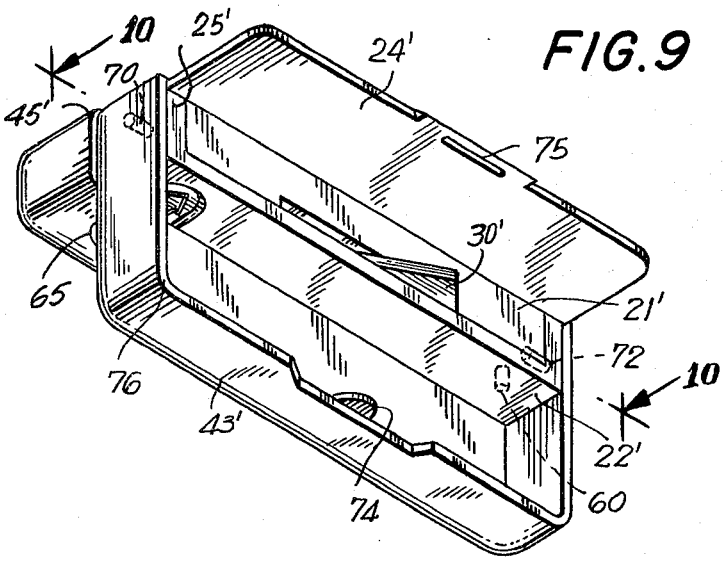
FIG. 9
FIG. 10
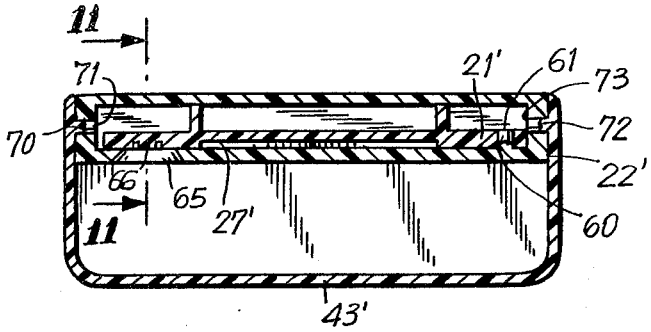
FIG. 12
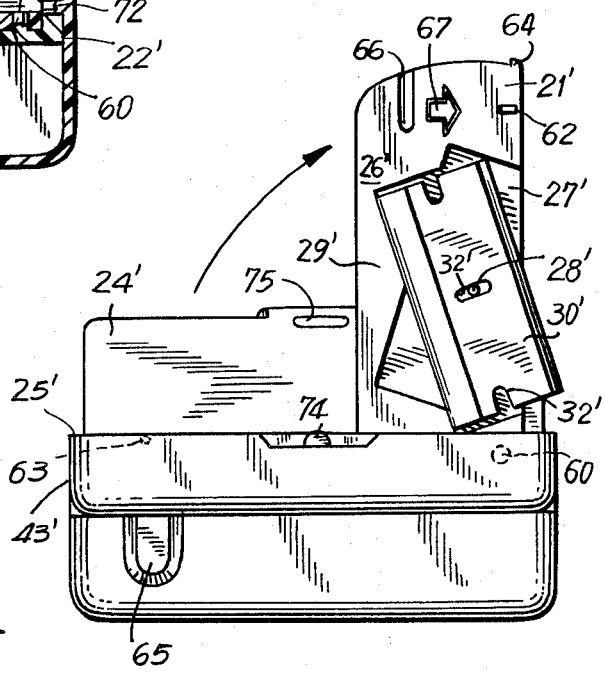
FIG. 11
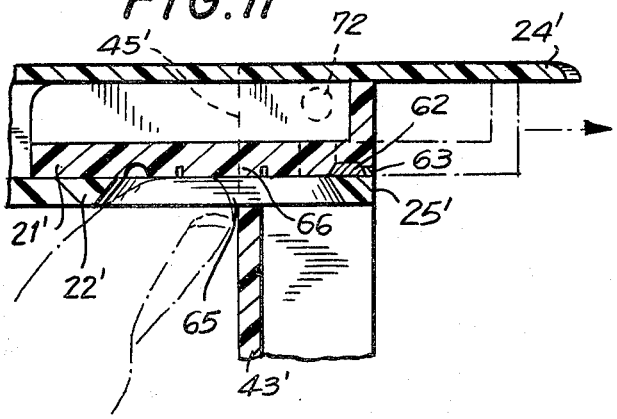

CORRUGATED CARTON CUTTER

BACKGROUND OF THE INVENTION

The present invention relates to utility knives in general, and more particularly to such utility knife or cutter which is especially constructed and suited for cutting open corrugated boxes along their edges, without damaging the contents thereof.

Utility knives and similar tools are already known in a variety of constructions. In most instances, such utility knives utilize a cutting blade which is constituted by or has a configuration resembling that of a razor blade. Yet, generally speaking, the cutting blade may have any shape which is best suited for the performance of the cutting action. The cutting blade is then immovably mounted in a holding arrangement or holder in such a manner that at least one cutting edge of the cutting blade is exposed so that it can be inserted into the object to be cut and an incision can be made by moving the holder relative to the object in such a way that the cutting edge of the cutting blade is in front.

Utility knives of this construction can be used, for instance, for cutting open boxes, especially of corrugated board, to gain access to the contents thereof. This cutting operation is usually to be performed as close to the respective edge of the box as possible to assure that, after the cutting operation is completed, for instance, by cutting along at least three of the top edges of the box, the remainder of the box will not fall apart and spill the contents thereof, while convenient removal of the contents, without undue manipulation, is assured after the top portion of the box has been moved into its open position.

An application in which such utility knives are frequently used is in opening boxes in supermarkets and similar commercial establishments. In this environment, the box to be cut open often is a shipping carton whose contents consists of a multitude of smaller cartons each of which contains the item to be sold, be it a quantity of cereal, or another foodstuff, or of other flowable material, or another item or a plurality of items contained in a package. Regardless of the item or items contained in the box, it is undesirable from the viewpoint of the manufacturer of the item and, in most instances, even from the viewpoint of the store owner, when the smaller carton or package is damaged or destroyed during the cutting operation, be it because the contents of such smaller box may spill if the smaller box is damaged and thus require a cleaning operation which detracts from more productive work of the store employee, or because the appearance of the smaller box on display is less attractive and hence less likely to lure the potential customer into purchasing the item contained in the box. The incentive to avoid damage to the smaller packages is even greater for the manufacturers, many if not all of whom have established a policy of giving credit to their customers for damaged packages. This credit may take the form of full refund for any returned damaged packages, in which case the customer has no incentive to keep the number of the damaged packages to a minimum. To make the customer interested in the amount of damage, many manufacturers give a credit in the form of a certain percentage of the items delivered, so that any damage in excess of this flat rate will be the responsibility of the store owner, and any lowering of the damage below the flat rate will inure to the benefit of the store owner. This, however, does not assure that the person doing the actual cutting will be careful not to damage the smaller packages contained in the large carton or box while cutting the latter open, since such a person has only a minimum stake in the outcome of the cutting operation and, in many instances, is not very skilled to begin with.

In view of this situation, attempts have already been made to develop a utility knife especially suited for the above-discussed purpose of cutting open large boxes containing a plurality of smaller packages with minimum, if any, damage to the latter. The results of these attempts may be seen, for instance, in the U.S. Pat. Nos. 1,527,220; 1,908,851; 2,550,346; 2,682,104 and 3,430,339. However, these known solutions possess certain disadvantages, one of which is that such utility knives are rather unwieldy and are of multi-part construction. Thus, for instance, in the conventional constructions, the replacement of a worn-out cutting blade requires the manipulation of a great many separate parts, and is a very cumbersome and time-consuming operation, resulting in a substantial amount of down time. The manipulation of a great number of separate parts increases the likelihood that the blade replacement will not be done, and that individual parts are more prone to being mislaid. Moreover, the shapes of such conventional utility knives or implements are such that they cannot be simply put into a pocket, which results in a situation where they are often mislaid or even lost, resulting in additional loss of time and money. Moreover, the cutting edges of the cutting blades of these conventional arrangements are not altogether reliably guided at all times during the cutting operation, thereby sometimes resulting in a jagged cut in the box, especially when the level of carefulness is diminished. Apparently for these reasons, these conventional constructions, as advantageous as they may seem to be from the operational point of view, did not achieve wide acceptance in the field, and the cutting operation is usually performed by other utility knives which do not have the above drawbacks but which are more likely to cause damage to the contents of the box being cut open.

SUMMARY OF THE INVENTION

Accordingly, it is a general object of the present invention to avoid the disadvantages of the prior art.

More particularly, it is an object of the present invention to provide an implement for cutting open boxes, which does not possess the disadvantages of the conventional cutting implements of this type.

It is yet another object of the present invention to so construct the arrangement of the type here under consideration as to avoid damage to the packages contained in a box during the use of the arrangement for cutting open the latter.

Yet another object of the present invention is to so design the above arrangement as to be safe to use and capable of being carried in a pocket without damaging the same or injuring the user.

A concomitant object of the present invention is to develop a utility cutting tool which is simple in construction, inexpensive to manufacture, easy to use, and reliable in operation nevertheless.

In pursuance of these objects and others which will become apparent hereafter, one feature of the present invention resides in an arrangement for holding a cutting blade having at least one cutting edge, particularly for use as a utility knife, the arrangement comprising a holding member having a major surface and an edge delimiting the same; means for holding the blade on the major surface in at least one position in which the cutting edge of the blade is at least partially situated beyond the delimiting edge of the holding member, with freedom of movement only in one direction substantially normal to the major surface; a confining member; and means for guiding the confining member on the holding member for movement relative thereto between a first position in which it does not interfere with the movement of the blade in and opposite to the one direction and a second position in which it confines the blade between itself and the major surface.

A particular advantage of the construction described so far is that it is exceptionally easy to gain access to the cutting blade mounted in the holding arrangement, for instance, for the purpose of replacing or reorienting the cutting blade, by simply moving the holding and confining members relative to one another out of the second position into the first position. Yet, due to the confining action of the confining member in the second position, combined with the holding action of the holding means, the cutting blade is firmly held in position in the holding arrangement and cannot move relative thereto even as substantial forces are applied to the cutting blade or to the cutting edge thereof during its penetration into the material being cut.

Advantageously, the holding means is so arranged relative to the major surface of the holding member that the cutting edge of the blade extends at an acute angle relative to the delimiting edge of the holding member in the one position of the blade. A particular advantage of this feature is that the cutting edge is in a position during the cutting operation in which the cutting action encounters the least amount of resistance, especially since the material being cut cannot accumulate in front of the cutting blade. To make the arrangement as convenient to use to left-handed persons as it is to right-handed persons, it is further proposed in accordance with the present invention to so configurate the holding means as to also hold the blade on the major surface in another position in which the cutting edge of the blade is inclined at an oppositely oriented acute angle relative to the delimiting edge of the holding member and extends beyond the latter.

A particularly simple and otherwise advantageous construction of the holding means is obtained when it includes means for defining a recess for accommodating a portion of the blade at the major surface. However, when the cutting blade has at least one opening therein, it is advantageous when the holding means includes, instead or in addition to the above defining means, at least one projection on the holding member at the major surface thereof, this projection extending into the opening of the blade when the latter is juxtaposed with the major surface, that is, especially in the aforementioned one or other position thereof.

According to another aspect of the present invention, the guiding means includes means for bounding a channel in the confining member, this channel fittingly receiving at least a predominant part of the holding member in the second position and guiding the holding member during the movement thereof relative to the confining member between the first and second position. It is particularly advantageous in this context when the confining member embraces the holding member, that is, when it surrounds the latter on all sides with the exception of a slot which connects the channel of the confining member with the exterior of the latter and receives a part of the blade during and upon assembly of the holding and confining members with one another. To prevent the holding and confining members from inadvertently moving out of the second position thereof relative to one another, it is further advantageous to provide retaining means on such members, such retaining means keeping the members in their second position. A particularly simple embodiment of this aspect is obtained when the retaining means includes at least one elastic projection on one of the members, and at least one recess in the other of the members for receiving the projection in the second position of the members relative to each other.

When the arrangement described above is to be used predominantly or exclusively for opening filled boxes, especially of corrugated board, by cutting along an edge region thereof which is formed by two adjacent external surfaces of the respective box, it is particularly advantageous to provide the holding arrangement with a contact surface substantially normal to the major surface of the holding member and operative to contact one of the adjacent surfaces of the box next to the cutting blade during the cutting operation, and with a distancing surface substantially parallel to and spaced a predetermined distance from the cutting blade and extending beyond the contact surface to engage the other of the adjacent surfaces of the box during the cutting operation and thus to keep the cutting blade at the predetermined distance from the other adjacent surface. It will be appreciated that, so long as the contact and distancing surfaces are kept in contact with the associated adjacent surfaces of the box to be opened during the cutting operation, they will maintain the cutting blade in the desired position relative to the edge at which the two adjacent surfaces of the box meet, thus assuring the desired degree of penetration of the cutting blade into the box, and distancing of the blade from the surface of the box which is parallel thereto by an amount sufficient for the cutting blade to avoid the material of the wall of the box which extends parallel to the blade. In this respect, it is particularly advantageous when the predetermined distance amounts at least to substantially twice the thickness of the material of the box, since then the cutting blade will clear the wall parallel thereto even at a region of overlap of two portions of flaps of the box. On the other hand, the holding means so holds the cutting blade in the one or the other positions thereof that the cutting edge of the blade extends beyond the contact surface of the holding arrangement to an extent amounting at least to once the thickness of the material of the box. However, the cutting blade may advantageously extend beyond the contact surface to at least twice the thickness of the material of the box so as to be able to cut through regions of the box walls at which the material is present in double thickness. Yet, even under these circumstances, the packages accommodated in the interior of the box will not be damaged since, due to the presence of the distancing surface, the cutting blade cannot get as close to the internal package as to damage the same. Advantageously, the contact and distancing surfaces are provided on the confining member.

According to a further advantageous concept of the present invention, the holding arrangement further comprises a cover for the cutting edge of the blade, and means for mounting the cover on the holding arrangement, that is, on one of the holding and confining members thereof, for displacement between an inoperative position in which the cutting edge is exposed for performing the cutting operation, and an operative position in which the cutting edge is covered. By resorting to this expedient, it is possible to transport the holding arrangement from one location to another without danger of damage or injury, for instance, in a pocket of an apron or another garment worn by the user of the holding arrangement, with the cutting blade mounted in the holding arrangement in its cutting position. Particularly good results both to the simplicity of operation and the likelihood that the user will close the cover after each use are obtained when the mounting means is constituted by at least one hinge which mounts the cover on one of the holding and confining members of the holding arrangement. This is especially true when at least the one member is of an elastic material, when the cover is of one piece with the one member; and when the hinge is a reduced-thickness region between and of one piece with the cover and the one member.

In a currently preferred construction of the holding arrangement incorporating this expedient, the one member is the holding member, and the reduced-thickness region constituting the hinge is disposed in the aforementioned slot of the confining member. Then, it is also advantageous when the confining member has an abutment portion or surface which extends along the reduced-thickness portion of the cover-holding member combination and which forms an abutment for the cover in the inoperative position of the latter, while not interfering with the displacement of the cover toward and into its operative position. The abutment portion is advantageously so positioned that an engagement surface of the cover is situated substantially in the same plane as the contact surface of the confining member in the inoperative position of the cover, in that the engagement of the engagement surface of the cover with the box being cut provided additional guidance for the holding arrangement on the box and additional safeguard against too deep a penetration of the cutting blade into the interior of the box.

An important consideration in the design of the holding arrangement according to the present invention is to assure that the cover will not accidentally open and thus expose the blade with a danger of possible damage to the garment worn by or injury to the user. To this end, the holding arrangement is equipped with means for releasably arresting the cover in the operative position thereof. Such arresting means advantageously includes at least one elastic projection of one, and at least one receiving recess for the projection in the other, of the one member and cover, the receiving recess receiving the projection in the operative position, and in the operative position only, of the cover. It is further important to make sure that the aforementioned members cannot move relative to one another when the cover is in its operative or closed position, since the consequence of this movement would also be uncovering or exposing the cutting edge. Hence, appropriate means are provided for preventing this from happenning, such preventing means advantageously comprising a projection on the other of the aforementioned member, that is, on the member which does not carry the cover, especially on the confining member, this projection extending into the trajectory of movement of the cover with the one member between the first and second position when the cover is in its operative position.

Last but not least, the cover has a recess for receiving the portion of the cutting blade which extends out of the slot of the confining member when the cover is in its operative position. In this manner, accidental touching of the cutting edge is rendered even more difficult if not impossible so long as the cover is in its operative position, since the cutting blade is protectedly received in the recess of the cover. Best results are obtained when the recess of the cover has a configuration conforming to that of the cutting blade at least in the one, but preferably also in the other, of the positions of the blade on the major surface of the holding member. In this event, the surfaces bounding the recess will hug the cutting edge and thus securely prevent access thereto in the operative or closed position of the cover.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWINGS

FIG. 4 is a fragmentary exploded view of the embodiment of FIG. 1 of the present invention;

FIG. 5 is a perspective view of the embodiment of FIG. 1 as seen from behind and with a hinged cover in its inoperative open position;

FIG. 6 is a front elevational view of a part of the embodiment shown in FIG. 5 but with the cover in its operative closed position;

FIG. 7 is a sectional view taken on line 7—7 of FIG. 6;

FIG. 8 is a section taken on line 8—8 of FIG. 7;

FIG. 9 is a perspective view of another arrangement according to a currently preferred embodiment of the present invention;

FIG. 10 is a sectional view taken on line 10—10 of FIG. 9;

FIG. 11 is a sectional view taken on line 11—11 of FIG. 10; and

FIG. 12 is a bottom view of the embodiment of FIG. 9, as seen with a cutting blade in its unconfined position.

DETAILED DESCRIPTION OF THE PREFERRED EMBODIMENTS

Figure 1:
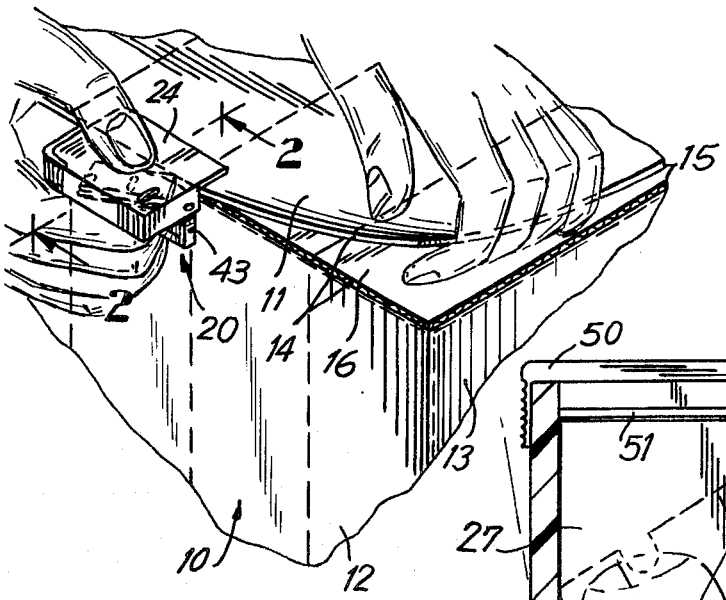
FIG. 1 is a perspective view of one embodiment of an arrangement according to the present invention as used for cutting open a box long its top edge.

Referring now to the drawing in detail, and first to FIG. 1 thereof, it may be seen that the reference numeral 10 has been used therein to identify a box or shipping carton which is to be opened. The box 1 includes, as seen in the illustrated position, a top wall 11 and two side walls 12 and 13 which, in the closed condition of the box 1, meet with the top wall 11 at respective edges 14 and 15. The edge regions surrounding the edges 14 and 15 on the top wall 11, and on the respective side walls 12 and 13, respectively, are shown in FIG. 1 to be already partially cut by a cutting implement or tool 20.

Figure 2:
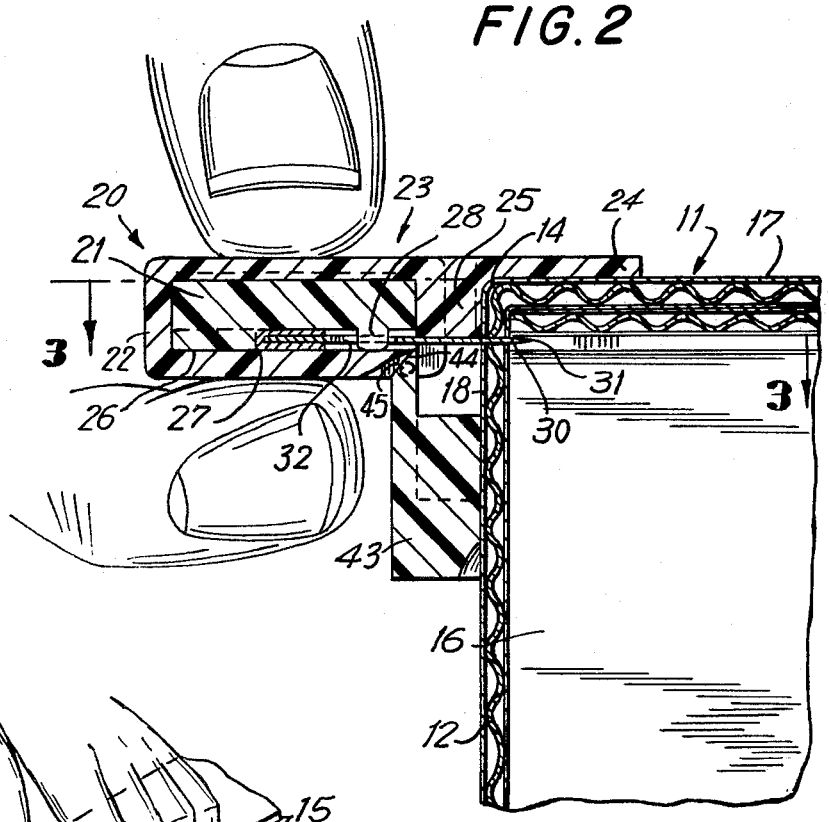
FIG. 2 is a cross-sectional view of the embodiment of FIG. 1, also as used at the same region of the box.

As shown in FIG. 2, the tool 20, which is constructed as a cutting knife, includes a holding member 21 and a confining member 22 which together constitute a bipartite holding arrangement 23 (see FIG. 4). A cutting blade 30 having a cutting edge 31 is mounted on the holding arrangement 23, being confined between the holding member 21 and the confining member 22.

As may be seen from the comparison of FIGS. 1 and 2, the box 10 is filled with a multitude of smaller boxes, cartons or packages 16, usually but not necessarily of the same size, which are to be removed from the interior of the shipping carton 10 at the desired destination, after the shipping carton 10 has been cut open by the cutting tool 20.

To avoid damage to the packages 16 during the cutting operation, it is necessary to assure that the cutting blade 30 travel as close to the top wall 11 of the box 10 as possible or feasible, and that it extend into the interior of the box 10 only to the extent necessary to obtain the cutting action at all regions of the box 10. For this reason, the confining member 22 is provided with a portion 24 which is, during the cutting operation, in contact with an external surface 17 of the top wall 11 of the box 10 adjacent to the respective corner 14, the portion 24 being arranged at a predetermined distance from the cutting blade 30 and thus determining how far from the edge 14 will the cutting blade 30 penetrate into the side wall 12. As shown in FIG. 2, the distance between the cutting blade 30 and the distancing portion 24 is substantially twice the thickness of the material of the box 10, to take into account the fact that, due to an overlap of flaps of the box 10 in the top wall 11, the latter has a double thickness at least close to the edge 14, and it is desired to cut the box 10 as close below the top wall 11 as possible. It may also be seen in FIG. 2 that, even though the packages 16 are densely packed in the interior of the box 10, a small clearance still exists between the top wall of the respective package 16 and the top wall 11 of the box 10, and it is into this clearance that the cutting blade 30 extends. It will be appreciated that the more closely the distance matches the thickness of the top wall 11, the less likely it is that the package 16 will be damaged during the cutting operation; nevertheless, there are practical limits to how closely the cutting blade 30 can follow the inner surface of the top wall 11 without interfering therewith, so that the existence of the clearance is a necessary precondition for the cutting blade 30 to be able to penetrate into the interior of the box 10 and yet not to damage the respective package 16. The width of the clearance need only be a small fraction of an inch, and such a minumum clearance is always present at the top of the box 10, due to the settling of the packages 16 during transportation.

As mentioned before, it is also advisable to control the extent to which the blade 30 penetrates into the interior of the box or shipping carton 10 beyond the side wall 12 during the cutting operation. To this end, the confining member 22 has a contact portion 25 having a contact surface which engages an external side surface 18 of the side wall 12 of the box 10 next to the respective edge 14 during the cutting operation, thus preventing the cutting blade 30 from penetrating deeper into the wall 12 than desired. The contact surface of the contact portion 25 and the distancing surface of the distancing portion 24 of the confining member 22 are advantageously arranged at a right angle to one another and, as shown, the distancing portion 24 and the contact portion 25 are arranged next to one another and merge with each other.

Figure 3:
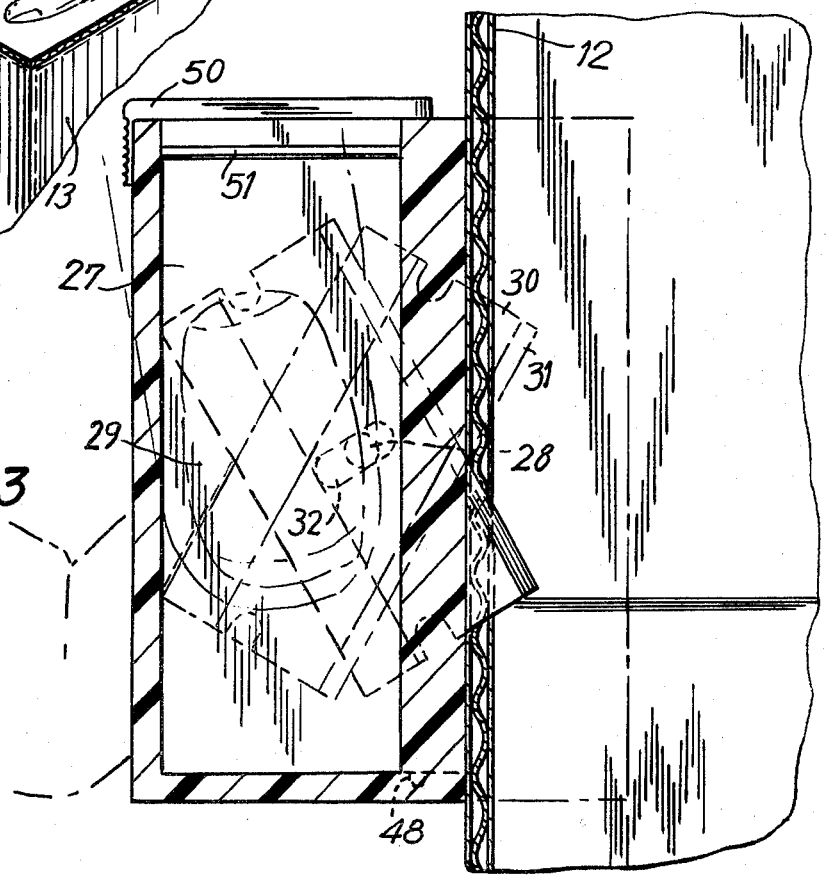
FIG. 3 is a sectional view taken on line 3—3 of FIG. 2.

The holding member 21 has a major surface 26 at which the cutting blade 30 is arranged, preferably in a recess 27 configurated to hold the cutting blade 30 in a predetermined position relative to the holding member 21. Two of such positions are shown in FIG. 3 one of which is shown in full lines and is intended for right-handed persons, while the other is shown in dash-dotted lines and is intended for use by left-handers. In either event, the cutting edge 31 of the cutting blade 30 faces forwardly as considered in the direction of movement of the cutting tool 20 relative to the box 10 during the cutting operation and extends at a predetermined acute angle to the contact surface of the contact portion 25 of the confining member 22, the orientation of this angle being opposite for left-handers than for right-handers.

As illustrated in FIGS. 2 and 3, the cutting blade 30 has a central opening or slot 32, and the holding member 21 has a substantially pin-shaped projection 28 which is fittingly received in the slot 32 of the cutting blade 30 when the latter is mounted at the major surface 26. Thus, this projection 28, in cooperation with the surfaces bounding the recess 27, holds the cutting blade 30 in the desired position on the holding member 21, that is, in one or the other of the illustrated positions. The recess 27 may be bounded, for instance, by a substantially V-shaped abutment portion 29 against which the rear side of the cutting blade 30, that is, the side parallel to and spaced from the cutting edge 31, abuts to prevent turning of the cutting blade 30 about the pin-shaped projection 28. Due to the cooperation of the surfaces bounding the recess 27 with the projection 28, the cutting blade 30 only has a freedom of movement relative to the holding member 21 along the pin-shaped projection 28, that is, substantially normal to the major surface 26. However, the confining action of the confining member 22 prevents even this movement, so that the cutting blade 30 is securely held in the holding arrangement 23.

Turning now to FIG. 4, it may be seen therein that the confining member 22 has a generally C-shaped cross-section so as to embrace the holding member 21; in other words, the confining member 22 bounds a channel 40 which receives the holding member 21 and guides the same for movement relative to the confining member longitudinally of the channel 40. The channel 40 communicates with the exterior of the confining member 22 at least at one of its ends and, in addition thereto, longitudinally thereof through a slot 41 adjoining the contact portion 25. Of course, the cutting blade 30 extends through the slot 41.

As also shown in FIG. 4, the holding member 21 has an L-shaped abutment ridge 50 at one of its ends, the abutment ridge 50 serving as a stop which engages the confining member 22 during the movement of the latter relative to the holding member 21 in the longitudinal direction to the channel 40. The short leg 50*a* of the ridge 50 is ribbed to provide a user-grasping surface to aid the user to move the holding member along the channel. Shallow recesses or fingerholes 50*b* are formed on opposite sides of the confining member at a location remote from the short leg 50*a* to provide another convenient user-grasping surface to facilitate movement along the channel. The short leg 50*a* is received with an interference-type fit or camming-type action in a correspondingly contoured recess formed in the confining member, to thereby define an assembled position. Next to the abutment ridge 50, the holding member 21 is provided with an arresting ridge adapted to engage in the interior of the confining member 22 and thus to arrest the latter in the assembled position thereof relative to the holding member 21. Advantageously, as indicated in FIGS. 5 and 6, the arresting ridge 51 is received in a depression or recess 42 of the confining member 22 in the assembled position.

FIG. 4 also illustrates that the holding arrangement 23 further includes a cover 43 which, as shown, is integral with or of one piece with the holding member 21, being connected to the latter by a hinge 44. In the illustrated construction, the hinge 44 is constructed as a so-called living hinge, that is, a reduced-thickness portion of the same material as the holding member 21 and the cover 43 and of one piece therewith, the material of this combined component having at least a limited elasticity, so that the hinge 44 is flexible. In FIG. 4, the cover 43 is in its inoperative position in which it exposes the cutting blade 30 for the performance of the cutting operation, as it is in FIG. 2 where it may be seen that in this inoperative position an engagement surface on the cover 43 contacts the surface 18 of the box 10 at the opposite side of the cutting blade 30 from the contact portion 25, thus providing for additional guidance of the tool 20 on the box 10, as well as for an additional safeguard against too deep a penetration of the cutting blade into the interior of the box. The additional contact area provided by the engagement surface of the cover tends to insure that the tool will be properly positioned at the cover edge region of the box. The blade will thus be positively guided throughout the cutting stroke, thereby resulting in a clean, non-jagged cutting line. To maintain the cover 43 in this inoperative position against any further pivoting in the clockwise direction, the confining member 22 has an abutment portion 45 against which the cover 43 abuts at the region of the hinge 44 in the inoperative position.

The hinge 44 permits the cover 43 to pivot into its operative or closed position in which it prevents access to the cutting edge 31 of the cutting blade 30 in either one of the above-mentioned positions of the latter on the holding member 21. To render this possible, the cover 43 is provided with a cutout or recess 46 which is so configurated as to substantially conformingly extend along the cutting edge 31 of the cutting blade 30 in the closed position of the cover 43. The cover 43 is shown in its closed position in FIG. 7, where it is also indicated that the cover 43 may be provided with a bead-shaped protuberance or projection 7 which, as shown in FIG. 8, engages in a recess or indent 48 of the confining member 22 in the closed or operative position of the cover 43. As shown in FIG. 5, the confining member 22 has an end wall 49 provided with the indent 48.

Turning now to the currently preferred embodiment of the holding arrangement shown in FIGS. 9–12, wherein like parts corresponding to the first embodiment have been identified with primed numerals, it may be seen therein that the holding member 21' has a major surface 26' at which the cutting blade 30' is arranged, preferably in a recess 27'. The holding member 21' has at least one pin-shaped projection 28' which is received in a slot 32' of the blade 30' when the latter is mounted at the major surface 26'. Abutment portion 29' abuts the blade 30' to prevent turning of the same about the projection 28'. Due to the cooperation of the projection 28', the abutment portion 29' and the surfaces bounding the recess 27', the blade 30' only has a freedom of movement relative to the holding member 21' in a direction normal to the major surface 26'. However, the confining member 22' prevents even this movement, so that the blade 30' is securely held in the holding arrangment.

Just as in the preceding embodiment, the confining member 22' has a distancing portion having a distancing surface 24' which is, during the cutting operation, in contact with the external surface 17 of the top wall 11 of the box 10. The distancing surface 24' determines how far from the edge 14 of the box 10 the cutting blade 30' will penetrate into the side wall 12 of the box 10. In addition, the confining member 22' has a contact portion having a contact surface 25' which engages the external side surface 18 of the side wall 12 of the box 10 next to the respective edge 14 during the cutting operation, thus preventing the cutting blade from penetrating deeper into the wall 12 than desired. The contact surface 25' and the distancing surface 24' are advantageously arranged at a right angle to each other. Also, as shown, the outer planar surface of the holding member 21' is located in the same plane as the planar contact surface 25' in order to provide additional guidance for the holding arrangement on the box.

The holding member 21' is guided for pivoting movement relative to the confining member 22' between a first position (FIG. 12) in which the latter does not interfere with the movement of the blade for replacement purposes, and a second position (FIG. 9) in which the confining member confines the blade between itself and the major surface 26' of the holding member. The confining member 22' is provided at one side with a cylindrical pivot pin 60 which is received in a cylindrical hole 61 in the holding member, so that the latter can pivot about a vertical axis which is normal to the major surface 26'. An inclined ramp 62 on the holding member is resiliently displaced during the return pivoting movement to the second confined position, until the ramp 62 snaps into place behind a shoulder 63 (see FIG. 11) provided on the confining member to securely lock the holding member in the second confined position.

To assist the pivoting movement, a fingerhole 65 is formed in the confining member, and provides an unobstructed path to the holding member. A user inserts his finger through the fingerhole 65, and thereupon pushes the holding member outwardly away from its second confined position. A ribbed user-grasping surface 66 provides a frictional aid to assist the user in performing the pivoting movement without slipping thereon. An indicator, preferably an arrow 67, provides a visual aid to assist the user in moving the holding member in the correct direction to effect blade replacement. A handle portion 64 provides still another handhold to assist the user in grasping the holding member.

The holding arrangement also includes a cover 43' which is pivotally mounted on the confining member 22' for movement about a horizontal axis by horizontally-extending pivot pins 70, 72 which are journalled in mutually aligned passages 71, 73 formed in the confining member. The cover 43' is movable between its inoperative open position (FIG. 9) in which it exposes the blade and an operative closed position in which it conceals the blade.

In the operative closed position, a tongue 74 provided on the cover is received in tight-fitting arrangement within a slot 75 formed on the confining member. The frictional engagement between the tongue 74 and the slot 75 is sufficient to lock the cover in the closed position.

In the inoperative open position, an abutment portion 45' is provided on the confining member, and is operative to abut against the cover to maintain the same in its inoperative open position for the performance of the cutting operation. In the open position, the outer planar surface 76 of the cover is co-planar with the outer surface of the holding member, and with the outer surface of the confining member so as to provide additional contact area to insure that the tool will be properly positioned at the cover edge region of the box. This insures that the blade will be positively guided throughout the cutting stroke.

It will be understood that each of the elements described above, or two or more together, may also find useful application in other types of arrangements differing from the type described above.

While the invention has been illustrated and described as embodied in a cutting implement for opening corrugated board shipping cartons, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. An arrangement for holding a cutting blade having at least one cutting edge, particularly for use as a utility knife for opening filled boxes, especially of corrugated board, by cutting along the edge region of a box which is formed by two adjacent box surfaces, comprising:

(a) a holding member having a major surface and an edge delimiting the same;

(b) means for holding the blade on said major surface in at least one position in which the cutting edge of the blade is at least partially situated beyond said delimiting edge of said holding member, with freedom of movement relative to the latter only in one direction substantially normal to said major surface;

(c) a confining member having a contact surface substantially normal to said major surface of said holding member and operative to contact one of the adjacent surfaces of the box next to the cutting blade during the cutting operation, and a distancing surface substantially parallel to and spaced a predetermined distance from the cutting blade and extending beyond said contact surface to engage the other of the adjacent surfaces of the box during the cutting operation and thus to keep the cutting blade at said predetermined distance from the other adjacent surface;

(d) means for guiding said confining member on said holding member for movement relative thereto between a first position in which it does not interfere with the movement of the blade in and opposite to said one direction and a second position in which it confines the blade between itself and said major surface;

(e) a cover for the cutting edge of the blade, said cover having an engagement surface;

(f) means for mounting said cover on one of said members for displacement between an inoperative position in which the cutting edge is exposed and an operative position in which the cutting edge is covered; and (g) abutment means in the path of displacement of said cover, for positioning said engagement surface of said cover in substantially the same plane as said contact surface of said confining member in said inoperative position of said cover, said engagement surface contacting said one adjacent surface of the box together with said contact surface of said confining member to thereby provide for additional guidance of the cutting blade during the cutting operation.

2. The holding arrangement as defined in claim 1, wherein said holding means is so arranged relative to said major surface that the cutting edge of the blade extends at an acute angle relative to said delimiting surface of said holding member in said one position.

3. The holding arrangement as defined in claim 2, wherein said holding means is so configurated as to also hold the blade on said major surface in another position in which the cutting edge of the blade is inclined at an oppositely oriented acute angle relative to said delimiting edge of said holding member, extending beyond the latter.

4. The holding arrangement as defined in claim 1, wherein said holding means includes means for defining a recess for accommodating a portion of the blade at said major surface.

5. The holding arrangement as defined in claim 1 for use with a cutting blade having at least one opening therein, wherein said holding means includes at least one projection on said holding member at said major surface thereof extending into the opening of the blade when the latter is juxtaposed with said major surface.

6. The holding arrangement as defined in claim 1, wherein said guiding means includes means for bounding a channel in said confining member which fittingly receives at least a predominant part of said holding member in said second position.

7. The holding arrangement as defined in claim 6, wherein said confining member has a slot connecting said channel with the exterior of said confining member and receiving a part of the blade during and upon assembly of said members with one another.

8. The holding arrangement as defined in claim 7; and further comprising means for retaining said members in said second position thereof relative to one another.

9. The holding arrangement as defined in claim 8, wherein said retaining means includes at least one elastic projection on one of said members, and at least one recess in the other of said members for receiving said projection in said second position.

10. The holding arrangement as defined in claim 1, wherein said predetermined distance amounts substantially to twice the thickness of the material of the box.

11. The holding arrangement as defined in claim 1, wherein said holding means so holds the cutting blade in said one position thereof that the cutting edge of the blade extends beyond the contact surface to an extent amounting at least to once the thickness of the material of the box.

12. The holding arrangement as defined in claim 1, wherein said mounting means includes at least one hinge.

13. The holding arrangement as defined in claim 12, wherein said hinge mounts said cover on one of said members.

14. The holding arrangement as defined in claim 13, wherein at least said one member is of an elastic material; wherein said cover is of one piece with said one member; and wherein said hinge is a reduced-thickness region between and of one-piece with said cover and said one member.

15. The holding arrangement as defined in claim 14, wherein said one member is said holding member; and wherein said reduced-thickness region is disposed in said slot.

16. The holding arrangement as defined in claim 15, wherein said abutment means extends along said reduced-thickness portion and forms an abutment for said cover in said inoperative position.

17. The holding arrangement as defined in claim 1; and further comprising means for releasably arresting said cover in said operative position thereof.

18. The holding arrangement as defined in claim 17, wherein said arresting means includes at least one projection on one, and at least one recess in the other, of one of said members and cover, said recess receiving said projection in said operative position of said cover.

19. The holding arrangement as defined in claim 1; and further comprising means for preventing movement of said members out of said second position in said operative position of said cover.

20. The holding arrangement as defined in claim 19, wherein said preventing means includes a projection on the other of said members which extends into the trajectory of movement of said cover with said one member in said operative position of said cover.

21. The holding arrangement as defined in claim 7, wherein said cover has a recess for receiving the portion of the cutting blade which extends out of said slot in said operative position of said cover.

22. The holding arrangement as defined in claim 21, wherein said recess of said cover has a configuration conforming to that of the cutting blade at least in said one position of the latter.

23. The holding arrangement as defined in claim 1, wherein said guiding means includes means for bounding an elongated channel in said confining member which slidably receives at least a predominant part of said holding member in said second position, and wherein said holding member includes a stop abutment for arresting the sliding movement of the holding member relative to the confining member.

24. The holding arrangement as defined in claim 23, wherein said stop abutment is roughened to provide a first gripping surface, and wherein said confining member includes means for providing a second gripping surface to facilitate the sliding movement of said holding member between said first and said second positions.

25. The holding arrangement as defined in claim 23, wherein said confining member has a stop recess for cammingly receiving at least a part of said stop abutment with an interference-type fit in said second position.

26. The holding arrangement as defined in claim 1, wherein said guiding means includes means for mounting said holding member for pivoting movement relative to said confining member.

27. The holding arrangement as defined in claim 1, wherein said cover is mounted on said one member for pivoting movement relative thereto.

28. An arrangement for holding a cutting blade having at least one cutting edge, particularly for use as a utility knife for opening filled boxes, especially of corrugated board, by cutting along the edge region of a box which is formed by two adjacent box surfaces, comprising:

(a) a holding member having a major surface and an edge delimiting the same;

(b) means for holding the blade on said major surface in at least one position in which the cutting edge of the blade is at least partially situated beyond said delimiting edge of said holding member, with freedom of movement relative to the latter only in one direction substantially normal to said major surface;

(c) a confining member having a contact surface substantially normal to said major surface of said holding member and operative to contact one of the adjacent surfaces of the box next to the cutting blade during the cutting operation, and a distancing surface substantially parallel to and spaced a predetermined distance from the cutting blade and extending beyond said contact surface to engage the other of the adjacent surfaces of the box during the cutting operation and thus to keep the cutting blade at said predetermined distance from the other adjacent surface;

(d) means for guiding said holding member on said confining member for pivoting movement relative thereto between a first position in which the confining member does not interfere with the movement of the blade in and opposite to said one direction and a second position in which the confining member confines the blade between itself and said major surface;

(e) a cover for the cutting edge of the blade;

(f) means for mounting said cover on one of said members for pivoting displacement between an inoperative position in which the cutting edge is exposed and an operative position in which the cutting edge is covered; and (g) abutment means in the path of displacement of said cover, for positioning said cover in said inoperative position during the cutting operation.

29. The holding arrangement as defined in claim 28, and further comprising means for visually indicating the direction of pivoting movement of said holding member.

* * * * *